United States Patent [19]

Ikeda et al.

[11] Patent Number: 4,779,912

[45] Date of Patent: Oct. 25, 1988

[54] AUTOMOBILE DOOR LOCKING APPARATUS

[75] Inventors: Ichio Ikeda; Koji Ishii, both of Aichi, Japan

[73] Assignee: Kabushikikaisha Anseikogyo, Aichi, Japan

[21] Appl. No.: 60,290

[22] Filed: Jun. 10, 1988

[30] Foreign Application Priority Data

Dec. 26, 1986 [JP] Japan ..... 61-310710
Apr. 17, 1987 [JP] Japan ..... 62-94600

[51] Int. Cl.[4] ..... E05C 3/26

[52] U.S. Cl. ..... 292/336.3; 292/201; 292/DIG. 38

[58] Field of Search ..... 292/201, 336.3, 341.16, 292/DIG. 38

[56] References Cited

U.S. PATENT DOCUMENTS 4,093,289 6/1978 Inabayashi et al. ..... 292/201 X
4,502,718 3/1985 Sasaki et al. ..... 292/201 X

FOREIGN PATENT DOCUMENTS 54-30317 9/1979 Japan .

*Primary Examiner*—Richard E. Moore
*Attorney, Agent, or Firm*—Pollock, Vande Sande & Priddy

[57] ABSTRACT

A locking lever of a door latch can be operated either manually by operating a lock knob or electrically by applying a current to an electrically operating mechanism. The turning force of the mechanism is transmitted to the lever via a first oscillatory member and second one cooperative loosely with the first member. The second member operates to shift the lever to a lock or an unlock position after it has been turned by the first member by a prescribed angle. The first member energizes a return spring, the biasing force of which returns the first member to neutral position when the current to the mechanism is interrupted. The lock knob can be operated lightly since the mechanism with the first member at the neutral position does not obstructs the knob.

4 Claims, 5 Drawing Sheets

AUTOMOBILE DOOR LOCKING APPARATUS

BACKGROUND OF THE INVENTION

1. Field of the Invention

This invention relates to an automobile door locking apparatus and more particularly to one including an operating mechanism driven by an electric motor.

2. Description of the Prior Art

An automobile door locking apparatus disclosed in Japanese Published Utility model application No. 54-30317 is shown in FIG. 14. In such an automobile door locking apparatus, it is possible to operate a door latch 91 either manually with a lock knob 93 or electrically with an electric operating mechanism 94. When the locking apparatus is operated by the mechanism, however, the mechanism has the hazard of being accompanied by damage of reduction gears 96 and 97. Namely, if an oscillatory gear 98 is turned downward by a driving motor 95 via the reduction gears 96, 97, then a locking lever 92 is moved downwards via a rod 99. When the locking lever 92 is brought to a lock position and stopped abruptly there, the oscillatory gear 98 is also stopped quickly by the locking lever 92 via the rod 99. This quick stop of the oscillatory gear 98 causes the reduction gears 96, 97 and the motor 95 to stop quickly. These members, however, have a tendency to be turned inertially. Therefore a strong impulsive force is exerted on the teeth of the gears 96, 97 on account of the quick stop of the gears 96, 97 and the motor 95. As a result, some of the teeth are accompanied by a danger of break.

Furthermore, after the door locking apparatus having the above mentioned structure has been electrically operated, the rod 99, to which the oscillatory gear 98, the reduction gears 96, 97 and the motor 5 are connected, is returned to a neutral position by a return spring 100. Accordingly, the above mentioned manual operation of the door latch can be done with a weak force.

However, when the rod 99 begins to be returned by the return spring 100, the oscillatory gear 98, the reduction gears 96, 97 and the motor 95, which are all connected to the rod 99, are at rest. Thus it requires a strong force in effect to start the movement of these members. For this reason, the return spring 100 is required to generate a strong biasing force enough to start the movement.

If the biasing force of the return spring 100 is stronger the load of the motor in the electrical operation becomes so much the heavier. A large electric motor of high power is required as the motor 95.

On the other hand, when the return spring 100 of a large biasing force is operated to return the rod 99 to the neutral position, the oscillatory gear 98 and the reduction gears 97, 98 rotate at a high speed in the returning direction. As a result these gears generate loud meshing noises.

SUMMARY OF THE INVENTION

A first object of the present invention is to provide an automobile door locking apparatus which can be worked either to lock or to unlock a door latch by operating a lock knob manually.

A second object of the present invention is to provide an automobile door locking apparatus which can be worked either to lock or to unlock a door latch by the rotation of an electric motor.

A third object of the present invention is to provide an automobile door latch having less possibility that when a latch is worked by the turning force of an electric motor some teeth of the gears to transmit the turning force of the motor are damaged.

Namely, in an automobile door locking apparatus according to the present invention, the turning force of the electric motor is transmitted to a locking lever of a door latch in the following manner. The turning force of the electric motor is first transmitted to a first oscillatory member via reduction gears. It is then transmitted to a second oscillatory member via a push member formed on the first oscillatory member and a receive member formed on the second oscillatory member. It is further transmitted to the locking lever of the door latch. When the locking lever is moved by the turning force transmitted in this manner and is stopped at a lock position or an unlock position, the second oscillatory member as well is mechanically stopped. Then the first oscillatory member, the reduction gears and the electric motor are mechanically stopped in accordance with the positional relationship between the stopped push member and receive member. One of the push member and receive member is made of a elastic material. Accordingly, the inertial forces of the first oscillatory member, the reduction gears and the electric motor can be absorbed by the elastic material. The quick stop of the first oscillatory member, the reduction gears and the electric motor can be moderated. Namely, they can be stopped more slowly. As a result, the teeth of the reduction gears can be prevented from being broken.

A fourth object of the present invention is to provide an automobile door locking apparatus which can make a door latch be at a state in which the latch can be manually operated with a very weak force once it has been operated by an electric motor.

Namely, after the automobile door locking apparatus according to the present invention is operated by the electric motor, the first oscillatory member is returned to the neutral position by the return spring while the second oscillatory member is left at a position corresponding to the lock or unlock position of the locking lever. As a result, a gap is formed between the push member on the first oscillatory member and the receive member on the second oscillatory member. This gap enables the second oscillatory member to oscillate freely between the lock and unlock positions irrespective of the position of the first oscillatory member. Consequently, when the locking lever is manually operated with the lock knob the reduction gears and the electric motor do not put any load on the operator of the knob. Therefore the manual operation can be done with a weak force.

A fifth object of the present invention is to provide an automobile door locking apparatus in which the first oscillatory member can be returned to the neutral position by a return spring of weak force. As a result, it becomes possible to provide an automobile door locking apparatus which can use a small electric motor.

Namely, in the automobile door locking apparatus according to the present invention, the push member or the receive member, either one of which being made of a elastic material, absorbs the inertial force to deform. As the push member or the receive member deforms, it exerts a repelling force determined by the amount of the deformation and the elasticity of the material. In the present invention, this repelling force can be utilized to set the first oscillatory member in returning motion. Once it has begun to be returned it is sufficient to exert, on the first oscillatory member, a weak biasing force enough only to maintain the returning motion. Therefore the return spring to provide the biasing force may be one of small spring constant. When the locking apparatus is driven by the electric motor to the lock or unlock position, the return spring of small biasing force loads the electric motor little. Thus the output power of the electric motor may be relatively small and a small-type electric motor can be used.

A still other object of the present invention is to provide an automobile door locking apparatus in which the first oscillatory member can be set in returning motion to the neutral position, at a small initial speed, by making use of the repelling force established in the above mentioned manner and therefore can be returned to the neutral position at a small speed, generating little operation noise.

Namely, when the elastic push member or receive member is deformed, it stores a large repelling force corresponding to the amount of deformation. In the present invention, however, only a part of the repelling force is used in order to set the first oscillatory member in returning motion. Thus the initial speed of the returning motion is small. This small initial speed, in cooperation with the small biasing force of the return spring, decreases the speed at which the first oscillatory member is returned to the neutral position. Then the reduction gears rotate at a small speed during the returning motion of the first oscillatory member and generate little meshing noise. That is, the apparatus can be quietly operated.

Other objects and advantages of the invention will become apparent during the following discussion of the accompany drawings.

DETAILED DESCRIPTION OF THE PREFERRED EMBODIMENTS

Figure 1:
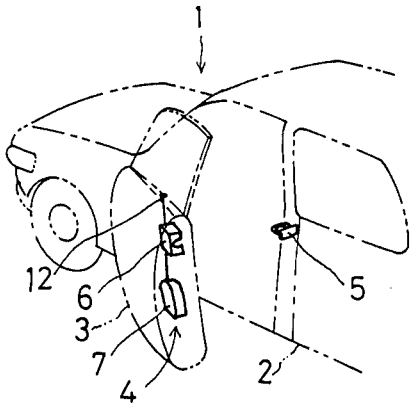
FIG. 1 is a perspective view of an automobile equipped with a door locking apparatus.
Figure 2:
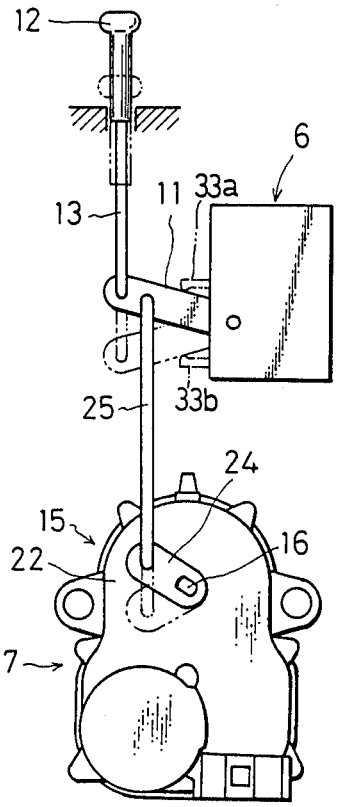
FIG. 2 is a view showing the relationship among a door latch, a lock knob and an electric operating mechanism.

In FIG. 1, an automobile door locking apparatus 4 includes a striker 5 mounted on a body 2 of an automobile 1, a door latch 6 mounted on a door 3 of the automobile 1 and an electric operating mechanism 7 mounted in the door 3. The door latch 6 is well known and has a locking lever 11 as shown in FIG. 2. This locking lever 11 can move oscillatorily between an unlock position shown by solid lines and a lock position shown in phantom in FIG. 2. A lock knob 12 for manual operation is connected to the locking lever 11 via a rod 13 in a well known manner.

Next, referring to FIGS. 2 through 5, the electric operating mechanism 7 is explained in details. The operating mechanism 7 comprises a case 15, an output shaft 16 mounted rotatably in the case 15, a first oscillatory member 17, a second oscillatory member 18, an electric motor 19, a reduction gear 20 to transmit the reduced rotational speed of the electric motor to the first oscillatory member and a return spring 21 to bias the first oscillatory member 17 towards a neutral position.

The case 15 comprises a case body 22 and a lid 23 put on it. These case body 22 and the lid 23 are both made of a plastic material.

The output shaft 16 is metallic and extents through the case 15 at one end thereof on which an output lever 24 is secured. The output lever 24 is connected, via a rod 25, to the locking lever 11 in the door latch 6.

Figure 4:
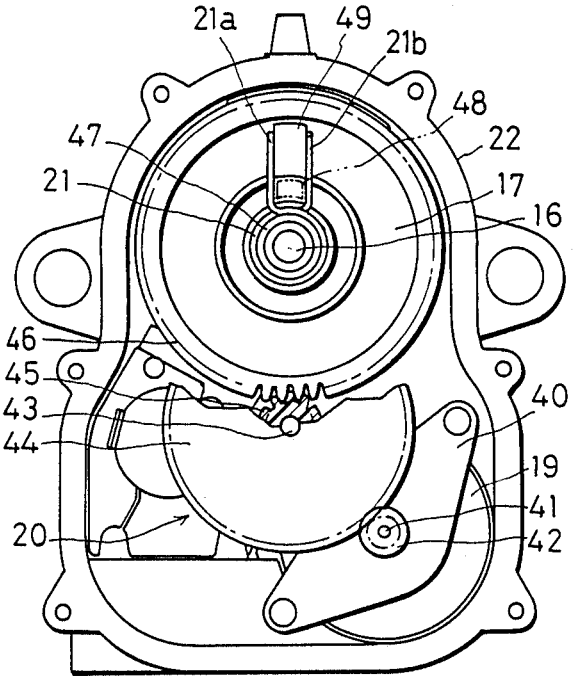
FIG. 4 is a front elevation of the electric operating mechanism with a lid removed and with reduction gears in partial section.

Next, the first oscillatory member 17 is made of a plastic material. This first oscillatory member 17 is mounted for free turning motion relative to the output shaft 16 and is adapted to move oscillatory with the neutral position as a central point as shown in FIG. 4. Furthermore this first oscillatory member 17 is provided, at the side thereof facing the second oscillatory member 18, with a first push member 26 to turn the second oscillatory member in the clockwise direction and with a second push member 27 to turn the second oscillatory member 18 in the counterclockwise direction. These push members 26 and 27 are made integrally with each other in the present embodiment. The push members 26, 27 are formed with counter surfaces **26*a* and 27*a* respectively, which face receive members 30 and 32 to be described hereinafter. The surfaces 26*a*, 27*a* are adapted to make finite angles against the azimuthal direction around the axis of the output shaft 16**.

Figure 3:
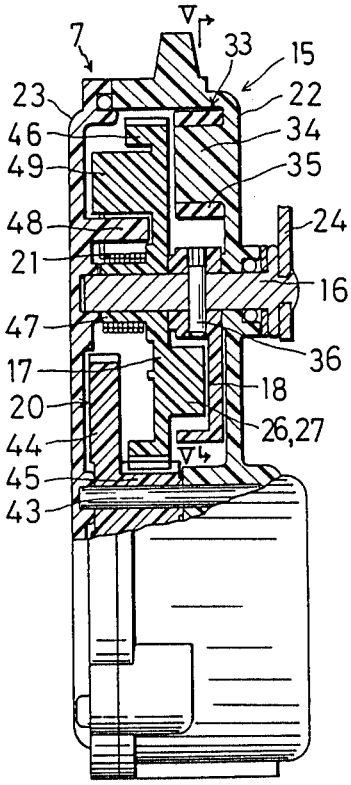
FIG. 3 is a side elevation in partial section of the electric operating mechanism.
Figure 5:
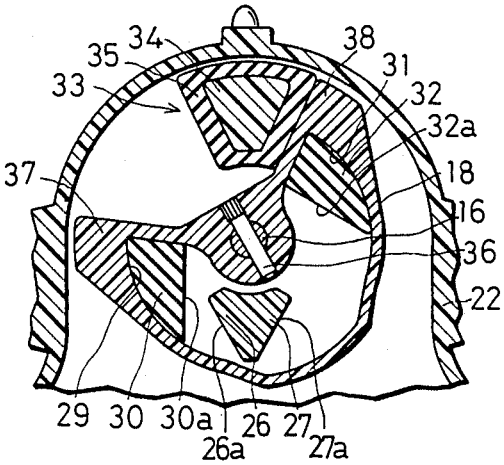
FIG. 5 is a section taken along a line V—V of FIG. 3.

Next, the second oscillatory member 18 is made of a plastic material and is secured on the output shaft 16 by a pin 36. The second oscillatory member 18 is formed with abutting members 37 and 38 for the lock and unlock positions respectively. These abutting members 37, 38 are adapted to abut on a stopper 33 provided in the case body 22 and to restrict the oscillation interval of the second oscillatory member 18 to between an unlock position shown in FIG. 6(A) and a lock position shown in FIGS. 6 (B) through 6 (E). These unlock and lock positions correspond to the unlock and lock positions of the locking lever 11 in the door latch 6. In two mounting recesses 29, 31 formed in the second oscillatory member 18 are set a first receive member 30 and a second receive member 32 which are adapted to receive the urging force of the first and second push member 26 and 27 respectively. The receive members 30, 32 are both made of an elastic material such as rubber. The receive surfaces 30*a*, 32*a* of the receive members 30, 32, which are to contact the push members 26, 27,, are inclined relative to the turning direction of the push members 26, 27 around the output shaft 16 as shown in FIG. 5. Furthermore the position of the receive members 26, 27 are determined so that the oscillatory interval of the second oscillatory member 18 between the unlock and lock positions may not restricted when the first oscillatory member is at the neutral position. Namely, this position is so determined that a space may be formed between the first push member 26 and the first receive member 30 and between the second push member 27 and the second receive member 32 whether the second oscillatory member is at the unlock position or the lock position. The stopper 33 to stop the abutting members 37, 38 consists of a projection 34 extending from the case body 22 and a cushion member 35, made of such as rubber, adapted around the projection 34 as shown in FIGS. 3 and 5. The stopper 33 and the abutting members 37, 38 are auxiliarily provided in order to prevent the locking lever 11 in the door latch 6 from being excessively moved beyond the unlock and lock positions. There are cases where such excessive motion of the locking lever 11 is prevented by stopper rods 33*a*, 33*b* provided in the door latch 6 as shown in FIG. 2. In these cases the stopper 33 and the abutting members 37, 38 may be omitted.

In the next place, the electric motor 19 is mounted in the case body 22 with a bracket 40. The motor 19 can rotate in either the normal or the reverse direction according to the direction of the current applied to the motor.

The reduction gear 20 includes a pinion 42 mounted on a rotary shaft 41 of the motor 19, a first gear 44 of a larger radius in mesh with the pinion 42, a second gear 45 of a smaller radius made integrally with the first gear 44 and a third gear 46 formed integrally with the first oscillatory member 17 and in mesh with the second gear 45. The first and second gears 44 and 45 are rotatably mounted on a shaft 43 supported in the case 16.

The return spring 21 is used for the purpose of returning the first oscillatory member 17 to the neutral position and is mounted on a spring mount 47 formed integrally with the first oscillatory member 17 as shown in FIGS. 3 and 4. A hook piece 48 formed integrally with the lid 23 of the case 15 and a cooperation piece 49 formed integrally with the first oscillatory member 17 are disposed between and in contact with one end 21*a* and the other end 21*b* of the return spring 21.

Figure 6A:
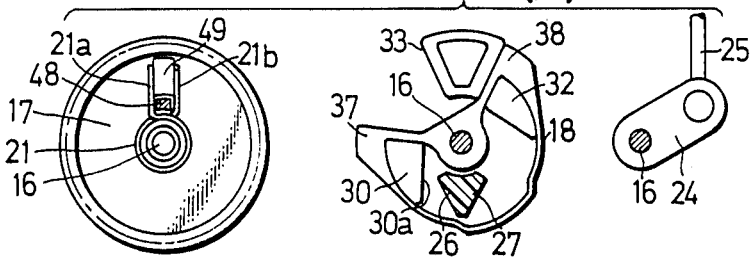
FIGS. 6(A) through 6(E) are views for explaining the operation of the electric operating mechanism.
Figure 6B:
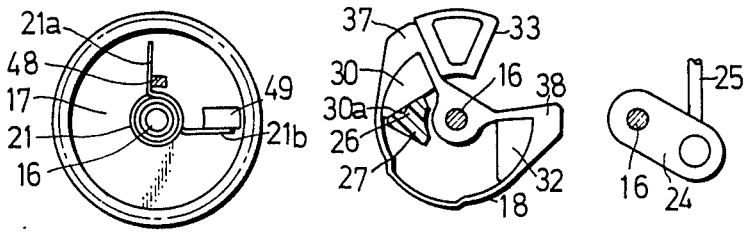

The operation of the above structure is now explained. First, the case is described in which the door latch 6 in the unlock state is locked by the electric operating mechanism 7. When the locking lever 11 of the door latch 6 is at the unlock position as shown by solid lines in FIG. 2, the output lever 24 and the second oscillatory member 18 are at respective unlock positions as shown in FIGS. 2 and 5 respectively. This situation is shown in FIG. 6(A) as well. In this situation, an electric current for locking operation is applied to the electric motor 19 by operating a switch not shown in a well known manner. The rotary shaft 41 of the electric motor 19 rotates in the clockwise direction in FIG. 4. The first oscillatory member 17 is turned clockwise via the reduction gear 20 by the rotary shaft 41. While the method 17 is being turned the first push member 26 abuts on the receive surface 30*a* of the receive member 30. After the member 26 has abutted on the surface 30*a* the second oscillatory member 18 is clockwise turned together with the first oscillatory member 17 until the member 18 is turned to the lock position shown in FIG. 6(B). At this lock position, the abutting member 37 abuts on the stopper 33 and the second oscillatory member 18 stops turning. As the second oscillatory member 18 is turned in this manner also the output shaft 16 is simultaneously rotated and the output lever 24 is shifted from the position of FIG. 6(A) to the position of FIG. 6(B). As a result, the locking lever 11 of the door latch 6 is shifted via the rod 25 by the output lever 24 to the lock position. In the above operating process, the spring edge 21*b* of the return spring 21 is moved by the cooperation piece 49 as shown in FIG. 6(B). As a result, a biasing force to return the first oscillatory member to the neutral position is stored in the return spring 21.

Figure 6C:
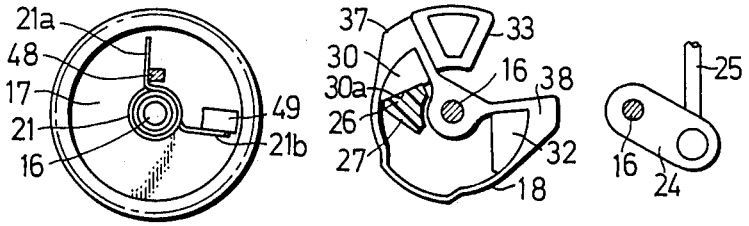
Figure 6D:
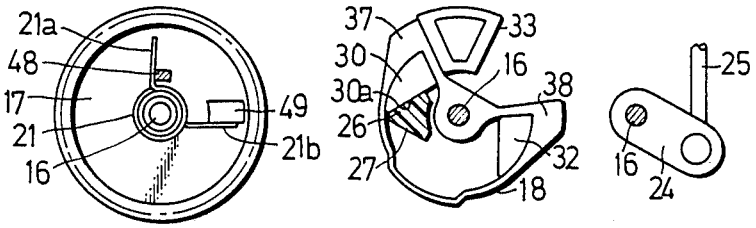
Figure 6E:
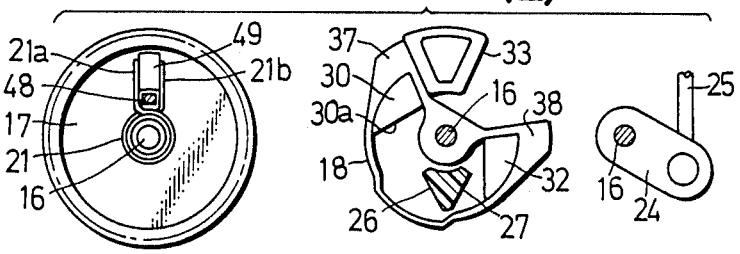

When the turning motion of the second oscillatory member 18 is stopped by the stopper 33, the first push member 26 is urged onto the receive surface 30*a* of the receive member 30 by the turning force applied to the first oscillatory member 17 by the motor 19 via the reduction gear 20 and the turning force due to the interia of the motor 19, the reduction gear 20 or the first oscillatory member 17, as shown in FIG. 6(C). The receive member 30 is compressed and the motor 19, the gear 20 and the first oscillatory member 17 stop soon. Namely, the receive member 30 absorbs the inertial force of the motor 19, the gear 20 and the first oscillatory member 17 to stop them moderately. Thus the teeth of the pinion 42, or the gears 44, 45, 46 cab be prevented from being broken.

After the motor 19 has been stopped, the current to it is interrupted. Then the receive member 30 exerts, on the first push member 26, a returning force in the counterclockwise wise direction in FIG. 6(C) that is, the repelling force established and stored in the receive member by the compression of the receive member 30. The first oscillatory member 17 and the reduction gear connected to it begin to be returned by this returning force. In this case, also the return spring 21 energized in the above mentioned manner exerts a counterclockwise returning force on the first oscillatory member 17 via the cooperation piece 49. When the first oscillatory member 17 begins to be returned, it is moved from the position of FIG. 6(C) to the position of FIG. 6(D). Thereafter the first oscillatory member 17 continues to be turned by the biasing force of the return spring 21 and is returned to the neutral position shown in FIG. 6(E).

Figure 8:
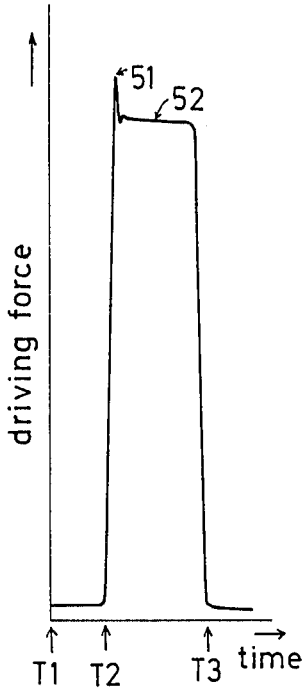
FIG. 8 is a graph showing the temporal variation of the driving force applied on a second oscillatory member.

In the above door locking apparatus, the push member 26 abuts on the receive member 30 after the first oscillatory member 17 has begun to be turned. Namely, the push member 26 abuts on the receive member 30 when the first oscillatory member 17, the reduction gear 20, the motor 19 and the like have obtained the considerable kinetic energy due to turning or rotating. Consequently, the second oscillatory member 18 can be given a driving force more powerful than the force which the motor 19 itself can put forth. The change of the driving force with time is explained in reference to FIG. 8. First, the motor 19 begins to rotate at a time T1. Then the push member 26 abuts on the receive member 30 at a time T2. In this case, the first oscillatory member 17 has still a kinetic energy on account of inertia. Accordingly, a strong driving force as indicated by a reference numeral 51 can be applied on the second oscillatory member 18 through the abutment of the push member 26 on the receive member 30. Even when the second oscillatory member 18 and the output shaft 16 are frozen to the case 15 or the locking lever 11 of the latch 6 is frozen, the enhanced driving force enables these members to begin to be moved. After the strong driving force enhanced by inertia has been applied, a normal driving force put forth by the motor 19 such as shown by a reference numeral 52 is exerted on the second oscillating member 18. When the current to the motor 19 is cut at a time T3 thereafter, the driving force exerted on the second oscillating member 18 vanishes.

Figure 7:
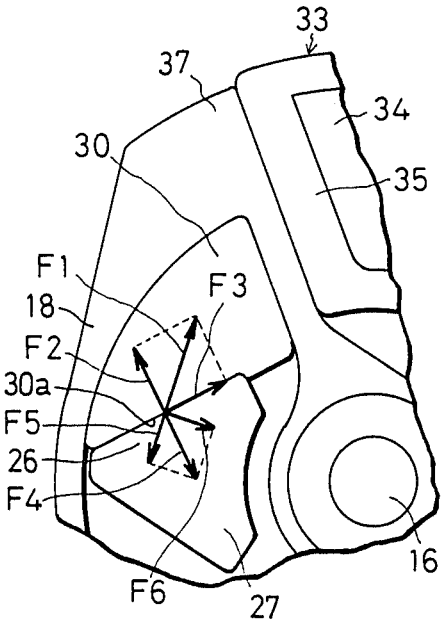
FIG. 7 is a view showing the relationship between the force applied on a receive member and an associated repelling force.

In reference to FIG. 7 is now explained the detail relationship among several forces which are generated when the first receive member 30 is compressed by the first push member 26 and the resulting repelling force is exerted on the push member 26 as a returning force. A reference character F1 in FIG. 7 shows the force which the first push member 26 exerts on the receive member 30*a* as the turning force of the motor 19 enhanced by the inertial impetus of the first oscillatory member 17, the motor 19 and the gear 20. This force F1 is directed in the azimuthal direction around the output shaft 16. The force F1 gives a component F2 pressing the receive surface 30*a* perpendicularly and a component F3 in parallel with the surface 30*a*. The component F3 is a friction force and is dissipated as heat. On the other hand, the receive surface 30*a*, exerted on by the component F2, gives the first push member 26 a component F4 as the repelling force. This component F4 is opposite to the component F2. The component F4 gives a component F5 in the azimuthal direction around the output shaft 16 and a radial component F6. Only the component F5 works as the force which puts the push member 26 back and returns the first oscillatory member 17. Accordingly, the force becomes very weak which the receive member 30 exerts on the first push member 26, returning the same. It is much weaker, for example, than the repelling force stored in the receive member 30 compressed by the push member 26. When the returning force is weak to such a degree, the first oscillatory member 17 and the reduction gear 20 begin to be turned at a small initial speed. Consequently, the reduction gear 20 rotates at a small speed while the first oscillatory member 17 is returned to the neutral position. Thus the meshing noise generated between the gears 45 and 46 or between the gear 44 and the pinion 42 can be suppressed within a low level.

When the door latch 6 is unlocked from the lock state by the electric operating mechanism 7, a current of the polarity opposite to that in the aforementioned locking case is applied to the motor 19. Then the motor 19 rotates in the direction opposite to that in the aforementioned operation. As a result, each member or component operates in the direction opposite to that in the aforementioned case. The door latch 6 is thus unlocked.

The manual operation is now explained. The locking lever 11 is shifted to the lock or unlock position by lowering or raising manually the lock knob 12. In this case, the second oscillatory member 18 is moved either to the lock position shown in FIG. 6(E) or to the unlock position shown in FIG. 6(A) by the manual force transmitted to the member 18 via the rod 25, the output lever 24, the output shaft 16 and so on. When the second oscillatory member 18 is moved in this manner, the motion of the second oscillatory member 18 is not transmitted to the first oscillatory member 17 since the member 17 is at the neutral position. Therefore the second oscillatory member 18 can be lightly moved. Accordingly, the lock knob 12 can be manually operated with a slight force.

As for the relationship of the materials constituting the first push member 26 and the first receive member 30, the former member may be made of an elastic material and the latter of a stiff material. There may be a similar relationship between the constituting materials of the second push member 27 and the second receive member 32.

Figure 9A:
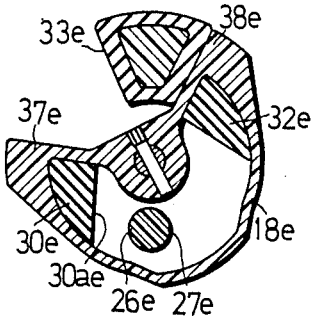
FIGS. 9(A) and 9(B) are sections showing a different example of the cross section of the push member.
Figure 9B:
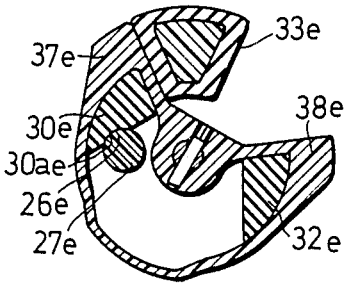

Next, FIGS. 9(A) and 9(B) show another embodiment of the present invention in which the cross sections of first and second push members 26*e* and 27*e* are made different from those in the preceding embodiment. In the present embodiment those members or components which are considered functionally same as or constructionally equivalent to those in the preceding drawings are given reference numerals same as previous ones but with an appended alphabet e. The repeated explanation of respective members is omitted. (Reference numerals in the succeeding drawings are given an appended alphabet f, g or h according to the same idea and the repeated explanation of respective members is similarly omitted.)

Figure 10A:
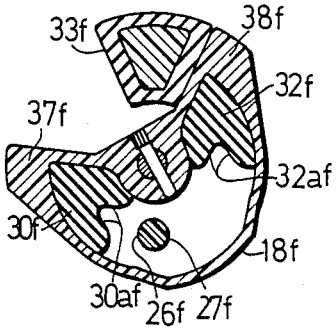
FIGS. 10(A) and 10(B) are sections showing an example in which a receive surface on the receive member has a V-shaped cross section.
Figure 10B:
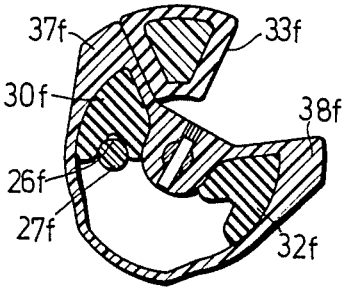

FIGS. 10(A) and 10(B) show an embodiment in which receive surfaces 30*af*, 32*af* on first and second receive members 30*f*, 32*f* are V-shaped.

Figure 11A:
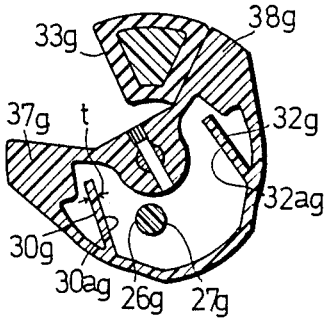
FIGS. 11(A) and 11(B) are sections showing an example in which the receive member is formed integrally with the second oscillatory member.
Figure 11B:
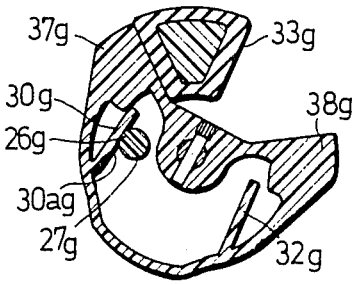

Next, FIGS. 11(A) and 11(B) show an embodiment in which first and second receive members 30*g*, 32*g* are made of a plastic body formed with an integral second oscillatory member 18*g*. The thickness t of receive members 30*g*, 32*g* is made suitably small and thus these members can generate a sufficient elastic repelling force when they are pushed by the push members.

Figure 12:
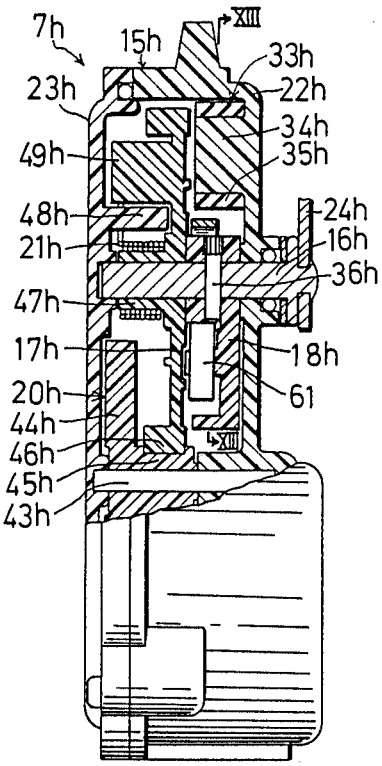
FIG. 12 is a fragmentary view showing another embodiment of the electric operating mechanism (a section taken at the same position as FIG. 3)
Figure 13:
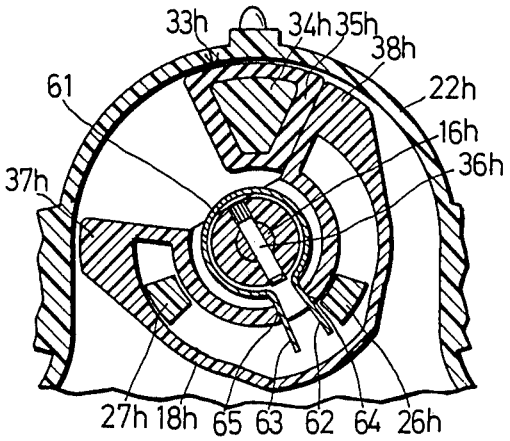
FIG. 13 is a section taken along a line XIII—XIII in FIG. 12.
Figure 14:
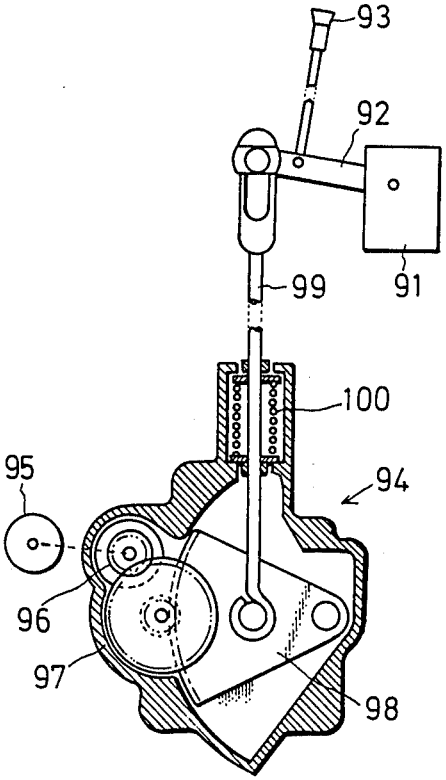
FIG. 14 PRIOR ART
FIG. 14 is front elevation in partial section showing a prior art door locking apparatus.

Next, in FIGS. 12 and 13, is shown an electric operating mechanism 7*h* including a different push member and a different receive member. In this electric operating mechanism 7*h*, a first push member 26*h* and a second push member 27*h* are formed independently of each other. Moreover a single spring 61 having a spring constant much larger than that of the return spring 21 forms the first and second receive members. This spring 61 is energized so that it may give an outward directed biasing force. Two spring edges 62 and 63 abut respectively on stop portions 64 and 65 formed with the oscillatory member 18*h*. The spring edge 63 works as the receive member to revive the pressing force of the first push member and the spring edge 63 as one to receive the pressing force of the second push member.

In the structure of this type, when the first oscillatory member 17*h* is moved by the introduction of electric current to the motor, the push member 26*h* presses the spring edge 62. As a result, the second oscillatory member 18*h* is turned. When the abut member 37*h* abuts on the stopper 33*h* and the second oscillatory member 18*h* stops turning, the spring 61 is compressed by the pressing force of the push member 26*h* and the spring edge 62 approaches nearer to the side of the spring edge 63. When the current to the motor 19 is interrupted thereafter, the push member 26*h* is urged by the biasing force of the compressed spring 61 and the first oscillatory member 18*h* begins to be returned.

As many apparently widely different embodiments of this invention may be made without departing from the spirit and scope thereof, it is to be understood that the invention is not limited to the specific embodiments thereof except as defined in the appended claims.

What is claimed is:

1. An automobile door locking apparatus including:

(1) a door latch provided with a locking lever adapted to be moved oscillatorily between a lock position and an unlock position;

(2) a manually operated lock knob connected to said locking lever; and (3) an electric operating mechanism to operate electrically said locking lever, said electric operating mechanism comprising:

(a) a case;

(b) a first oscillatory member adapted to be pivotally mounted for side to side oscillatory movement from a centered neutral position;

(c) a second oscillatory member mounted pivotally around a common axis around which said first oscillatory member is pivotally mounted;

(d) an electric motor rotatable in normal and reverse directions and connected to said first oscillatory member via a reduction gear; and (e) a return spring mounted on said first oscillatory member and adapted to bias said first oscillatory member to said neutral position, said second oscillatory member being connected to said locking lever of said door latch for cooperative movement, said first oscillatory member being provided with a first push member to turn said second oscillatory member in one direction and with a second push member to turn said second oscillatory member in the other direction, said second oscillatory member being provided with a first receive member to receive the pressing force applied by said first push member and a second receive member to receive the pressing force applied by said second push member, the positions of said receive members being determined so that such range of the oscillatory movement of said second oscillatory member, as corresponding to the interval between said lock and unlock positions of said locking lever, may not be limited by said first and second push members when said first oscillatory member is at said neutral position, and either one of said first push member and said first receive member and either one of said second push member and said second receive member being made of an elastic material.

2. An automobile door locking apparatus as set forth in claim 1 in which a hook piece extending toward said first oscillatory member is provided on said case, a cooperation piece is extended from said first oscillatory member at such a position that said hook piece and said cooperation piece are aligned along a radial direction of said first oscillatory member when said first oscillatory member is at said neutral position and further one end and the other end of said return spring are disposed with said pieces put therebetween.

3. An automobile door locking apparatus as set forth in claim 1 in which the positions of said first and second receive members are determined so that when said first oscillatory member is at said neutral position, a gap may be formed between said first receive member and said first push member and between said second receive member and said second push member whether said second oscillatory member is at one or another position corresponding to said lock or unlock position of said locking lever respectively.

4. An automobile door locking apparatus as set forth in claim 1 in which the contact surfaces of each pair of said push member and receive member are inclined relative to the azimuthal direction around the pivot axis of said first and second oscillatory members.

* * * * *